United States Patent [19]

Copeland, James L.

[11] Patent Number: 4,687,121

[45] Date of Patent: Aug. 18, 1987

[54] SOLID BLOCK CHEMICAL DISPENSER FOR CLEANING SYSTEMS

[75] Inventor: Copeland, James L., Burnsville, Minn.

[73] Assignee: Ecolab Inc., St. Paul, Minn.

[21] Appl. No.: 817,399

[22] Filed: Jan. 9, 1986

[51] Int. Cl.[4] ..... B67D 5/08

[52] U.S. Cl. ..... 222/64; 222/67; 222/185; 222/189; 222/190; 222/325; 134/93; 68/17 R; 137/268; 422/263; 422/264; 422/266

[58] Field of Search ..... 222/52, 64, 67, 185, 222/189, 190, 251, 352, 462; 422/261, 263, 264, 266, 267, 268, 274, 277, 264 B; 134/57 DL, 58 DL, 93; 68/17 R; 252/93; 137/268

[56] References Cited

U.S. PATENT DOCUMENTS

| | | | |
|---|---|---|---|
| 404,354 | 5/1989 | Huber . | |
| 871,612 | 11/1907 | Nesfield . | |
| 1,325,361 | 1/1919 | Harshberger . | |
| 1,380,388 | 6/1921 | Kaufman . | |
| 1,740,879 | 12/1929 | Sonner | 137/268 |
| 1,798,428 | 3/1931 | Lindgren . | |
| 1,932,070 | 10/1933 | Grant et al. | 141/9 |
| 1,945,351 | 1/1934 | Grafton | 220/62 |
| 1,949,264 | 2/1934 | Bagley | 226/69 |
| 1,975,749 | 10/1934 | Lang | 141/9 |
| 1,988,000 | 1/1935 | Estler | 225/12 |
| 2,031,853 | 2/1936 | Potts | 226/93 |
| 2,083,076 | 6/1937 | Mau | 23/268 |
| 2,120,807 | 6/1938 | Kundel | 299/34 |
| 2,138,943 | 12/1938 | Sinkwich | 141/9 |
| 2,238,969 | 4/1941 | Butterfield | 299/34 |
| 2,288,791 | 7/1942 | Culliton | 299/83 |
| 2,308,612 | 1/1943 | Lehmkuhl | 23/272 |
| 2,333,443 | 11/1943 | Robinson | 252/135 |
| 2,370,609 | 2/1945 | Wilson et al. | 175/183 |
| 2,371,720 | 3/1945 | Stine | 299/83 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 2,387,945 | 10/1945 | McDow | 299/84 |
| 2,412,819 | 12/1946 | MacMahon | 252/138 |

(List continued on next page.)

FOREIGN PATENT DOCUMENTS 8912 of 1916 United Kingdom ..... 422/263

OTHER PUBLICATIONS

Economics Laboratory, Inc., Warhead Chlorinated Brick Detergent, p. 1.
Klenzade Products, Inc., Detergent Bricks, pp. 1–2.
Economics Laboratory, Inc., Model C-8, pp. 1–3.
Economics Laboratory, Inc., C-33 Hydraulic Reservoir, p. 1.
Economics Laboratory, Inc., Detergent Reservoirs, pp. 1–2.
Economics Laboratory, Inc., Model C-11, pp. 1–2.
Economics Laboratory, Inc., Model C-4, pp. 1–2.

*Primary Examiner*—Joseph J. Rolla
*Assistant Examiner*—Edward S. Ammeen
*Attorney, Agent, or Firm*—Merchant, Gould, Smith, Edell, Welter & Schmidt

[57] ABSTRACT

A spray-type dispenser for on-demand dispensing of a solid block of chemical retained within a container in the form of an aqueous chemical solution of substantially constant concentration, comprising: (i) an upwardly dispoded spray nozzle, (ii) a three-dimensional support screen for supporting the solid block of chemical above the spray nozzle, and (iii) a housing enclosing the spray nozzle and support screen; the housing and support screen defining an annular cavity. In operation, a container retaining a solid block of a water-soluble chemical is placed within the dispenser such that the support screen contacts the chemical but not the container; thereby allowing the container to descend, by force of gravity into the annula cavity as the chemical retained therein is dissolved. The ability of the container to move in relation to dissolution of the chemical retained therein allows the dispenser to maintain a substantially constant distance between the spray nozzle and the exposed dissolving surface of the chemical and thereby maintains a substantially constant concentration of the aqueous chemical solution dispensed.

20 Claims, 13 Drawing Figures

U.S. PATENT DOCUMENTS

| | | | |
|---|---|---|---|
| 2,477,998 | 8/1949 | McCowan | 299/83 |
| 2,513,566 | 7/1950 | Kent | 422/263 |
| 2,604,386 | 7/1952 | Arant | 23/309 |
| 2,613,922 | 10/1952 | Gatchet | 259/4 |
| 2,641,506 | 6/1953 | Lowthers | 293/32 |
| 2,686,080 | 8/1954 | Wood | 299/83 |
| 2,698,022 | 12/1954 | Fahnoe | 137/79 |
| 2,738,323 | 3/1956 | Tepas, Jr. | 210/28 |
| 2,788,328 | 4/1957 | Merget | 252/135 |
| 2,802,724 | 8/1957 | Johnson | 23/267 |
| 2,820,701 | 1/1953 | Leslie | 23/271 |
| 2,920,417 | 1/1960 | Wertheimer | 45/28 |
| 3,048,548 | 8/1962 | Martin et al. | 252/135 |
| 3,070,316 | 12/1962 | Miville | 239/312 |
| 3,092,515 | 6/1963 | Pike et al. | 134/25 |
| 3,166,513 | 1/1965 | Mizuno et al. | 252/99 |
| 3,174,934 | 3/1965 | Shen | 252/135 |
| 3,306,858 | 2/1967 | Oberle | 252/99 |
| 3,322,507 | 5/1967 | Smith | 23/267 |
| 3,322,674 | 5/1967 | Friedman | 252/90 |
| 3,334,147 | 8/1967 | Brunelle et al. | 260/611 |
| 3,399,676 | 9/1968 | McLaughlin | 128/229 |
| 3,417,024 | 12/1968 | Goldwasser | 252/135 |
| 3,441,511 | 4/1969 | Otrhalek et al. | 252/135 |
| 3,444,242 | 5/1969 | Rue et al. | 260/611 |
| 3,507,624 | 4/1970 | Schneider, Jr. et al. | 422/263 X |
| 3,535,258 | 10/1970 | Sabatelli et al. | 252/105 |
| 3,556,982 | 1/1971 | Kaminsky et al. | 208/11 |
| 3,574,561 | 4/1971 | Nickerson et al. | 23/282 |
| 3,579,440 | 5/1971 | Bradley, Jr. | 422/264 X |
| 3,579,455 | 5/1971 | Sabatelli et al. | 252/135 |
| 3,595,438 | 7/1971 | Daley et al. | 222/67 |
| 3,598,372 | 8/1971 | Schneider, Jr. et al. | 137/268 X |
| 3,612,080 | 10/1971 | Schneider, Jr. et al. | 422/263 X |
| 3,639,286 | 2/1972 | Ballestra et al. | 252/109 |
| 3,680,070 | 7/1972 | Nystuen | 340/244 |
| 3,687,613 | 8/1972 | Rickard | 423/242 |
| 3,700,599 | 10/1972 | Mizuno et al. | 252/99 |
| 3,727,889 | 4/1973 | Nagel | 259/1 R |
| 3,816,427 | 6/1974 | Loliger et al. | 23/271 |
| 3,850,344 | 11/1974 | Burge et al. | 222/67 |
| 3,856,932 | 12/1974 | May | 424/16 |
| 3,899,436 | 8/1975 | Copeland et al. | 252/99 |
| 3,933,670 | 1/1976 | Brill et al. | 252/99 |
| 3,936,386 | 2/1976 | Corliss et al. | 252/99 |
| 4,014,808 | 3/1977 | Herpers, Jr. et al. | 252/135 |
| 4,020,865 | 5/1977 | Moffat et al. | 137/268 |
| 4,063,663 | 12/1977 | Larson et al. | 222/52 |
| 4,426,362 | 1/1984 | Copeland et al. | 422/263 |
| 4,462,511 | 7/1984 | Fulmer et al. | 422/261 X |
| 4,569,780 | 2/1986 | Fernholz et al. | 252/90 |
| 4,569,781 | 2/1986 | Fernholz et al. | 252/92 |

SOLID BLOCK CHEMICAL DISPENSER FOR CLEANING SYSTEMS

TECHNICAL FIELD

The invention relates broadly to the dispensing of solid, water soluble compositions used in cleaning processes. More particularly, the invention relates to the dispensing of cast chemical compositions used in cleaning processes. Such chemicals include detergents, rinse aids, and the like. Typically, the cast chemical composition is dispensed by contacting the chemical with an aqueous liquid to create a concentrated working solution.

BACKGROUND OF THE INVENTION

Automated institutional and industrial ware-washing machines are generally configured with one wash tank for maintaining a readily available supply of a cleaning solution for use in the machine. During normal usage at least a portion of the cleaning solution is discarded in order to keep the remaining cleaning solution as clean as possible. Fresh water or other clean recycled water is then added to the wash tank to maintain an appropriate liquid level, thereby diluting the concentration of detergent in the cleaning solution. To maintain the cleaning solution at the most efficient cleaning concentration, a measured amount of a concentrated aqueous detergent solution is periodically added to the wash tank by an auxiliary detergent dispenser to form a cleaning solution of the desired strength.

Automated institutional and industrial ware washing machines may also be constructed to add a rinse aid to the rinse water from an auxiliary dispenser to promote sheeting and reduce water spotting on the washed ware.

Automated institutional and industrial fabric washing machines typically create a new cleaning solution for each cleaning cycle to which is added detergent, bleach, fabric softener and other optional additives. Typically, these fabric washing additives are added to the wash water by auxiliary dispensers.

Chemical dispensers used in the processes described above typically have been designed for automatic or semi-automatic operation. Automatic dispensers eliminate the need for constant operator attention to the cleanliness of the wash water and concentration of chemical in the wash tank. Further, automated dispensers minimize operator error due to operator misjudgment in timing or in the amount of chemical to be added, and provides greater accuracy in maintaining the optimum concentration level of chemical in the system.

A number of different techniques have been developed and used for converting solid chemicals used in cleaning processes into a concentrated solution. The majority of such devices have been designed to convert solid powdered detergent. See for example Daley et al, U.S. Pat. No. 3,595,438, issued July 27, 1971; Moffet et al, U.S. Pat. No. 4,020,865, issued May 3, 1977; and Larson et al, U.S. Pat. No. 4,063,663, issued Dec. 20, 1977. For this reason the background of chemical dispensers will be further discussed with respect to the dispensing of a detergent.

One common detergent dispenser technique for converting powdered detergent, is the so-called "water-in-reservoir" type. In the water-in-reservoir type dispenser, the powdered detergent is completely submerged in an aqueous solution. A stand-pipe, usually located near the center of the dispenser tank, maintains a constant level of concentrated solution within the dispenser tank. As water is added to the dispenser tank, a concentrated, often saturated detergent solution or slurry is formed by the swirling action and agitation of the powdered detergent. The added water also causes a portion of the solution or slurry in the reservoir to flow into the stand-pipe, which directs the concentrated detergent solution to the wash tank of the washing apparatus. Such a dispensing technique is generally not practical for dispensing powdered detergents containing incompatible components (such as an active chlorine source in combination with a defoamer) as the incompatible components tend to react upon contact when in solution. Further, there are possible safety hazards involved with the use of such dispensers. Charging or recharging of water-in-reservoir type dispensers requires an operator to place detergent directly into standing water. Since water-in-reservoir type dispeners are typically mounted at about eye level or higher with respect to the operator, any splashing or splattering caused by adding the detergent directly into the concentrated solution poses the danger of spilling concentrated detergent solution onto the eyes, face and skin of the operator. This is particularly hazardous when adding highly alkaline or other such hazardous chemicals.

Another technique for converting a powdered detergent into a concentrated detergent solution involves pouring the powdered detergent onto the convex side of a conical or hemispherical screen having a mesh size smaller than the powdered detergent particles supported thereby. The powdered detergent which directly overlies the support screen is dissolved as needed by a fine mist or spray of water from a nozzle disposed below and on the concave side of the screen. The concentrated detergent solution formed by the action of the water falls by gravity into an underlying reservoir, or is directed by a conduit to the wash tank of a washing apparatus. (See, for example, U.S. Pat. Nos. 3,595,438 issued to Daley et al; 4,020,865 issued to Moffat et al; and 4,063,663 issued to Larson et al.) This technique solves many of the problems associated with the water-in-reservoir type of dispenser as (i) the entire charge of powdered detergent is not wetted, and (ii) an operator loading detergent into the dispenser is not placing detergent directly into standing water and therefore is not subjected to possible boil-over or splattering of the detergent solution.

While the powdered detergent dispensers such as described by the Daley, Moffat and Larson patents have represented significant contributions to the art of detergent dispensing, the use of powdered solid detergent in general has a number of drawbacks in commercial applications. Due to increased sanitary standards and demands for shorter wash times, recently developed detergents have relatively more complex compositions that are more hazardous to the user, less stable, and more difficult to dissolve in a satisfactorily uniform manner. Powdered detergents generally dissolve readily because of their high specific surface areas. However, when such powdered detergents include a mixture of a number of components having relatively different dissolving rates, the detergent is susceptible to differential solubility problems in automatic detergent dispensers; the extent of the solubility problem depending upon the rate of dispensing and the residence (dwell) time of contact between the detergent powder and the dissolving liquid. Those particles having a greater rate of solubility and/or a greater specific surface tend to dissolve first, whereas those having a lower solubility rate and/or a lower specific surface tend to dissolve last.

Another problem associated with powdered detergents is the incompatibility and/or instability of particular detergent components required for good cleaning action, when these components are combined in a powdered detergent composition.

Still another problem inherent in powdered detergent is segregation of different sized and/or weighted particles during manufacturing, shipping and handling. Even when uniform distribution can be achieved during manufacture, subsequent shipping and handling may cause segregation, leading to non-uniformity in the composition of the detergent when it is withdrawn from the container.

A further disadvantage of powdered detergents is that they are quite susceptible to spillage.

Another form of solid detergent is the detergent briquette which comprises pre-shaped briquettes of solid detergent. Dispensing systems for dissolving detergent briquettes are known in the art. See, for example, U.S. Pat. Nos. 2,382,163, 2,382,164 and 2,382,165 all issued Aug. 14, 1945 to MacMahon, and U.S. Pat. No. 2,412,819, issued Dec. 17, 1946 to MacMahon. In the MacMahon systems, the detergent briquettes are dispensed from a modified water-in-reservoir type dispenser wherein a number of the briquettes are held in a mesh basket forming a slot across the diameter of a reservoir. A stream of water directed against the lowermost briquette, in combination with the swirling action of the water engaging the submerged portion of the lower-most briquette, provides the dissolving action. The primary advantage of using detergent briquettes in such dispensers is that the user can visually determine when the detergent dispenser reservoir requires additional detergent. As with the water-in-reservoir dispensers, however, water is left standing in the reservoir, and a portion of the briquettes are submerged within that water. Accordingly, where there are incompatible components within the detergent briquettes, there can be undesirable interaction therebetween. Further, if the detergent contains a defoamer, that defoamer tends to float to the top of the reservoir during periods of inactivity, forming a slag at the water surface. For these and other reasons, the briquette detergent approach has not attained that degree of commercial success in the conventional institutional and industrial washing machine art as has the powdered detergent dispensing approach.

Still another, more recent, form of solid detergent is the "cast" or block form, comprising detergent cast within a mold or container. Dispensing systems for these solids are known in the art. See, for example, U.S. Pat. No. 426,362 issued to Copeland et al and commonly owned U.S. Pat. Nos. 4,569,781 and 4,569,780, issued Feb. 11, 1986 to Fernholz et al. The cast detergent is dispensed by spraying a solvent onto the detergent block within the container, thereby dissolving the exposed surface of the detergent to form a concentrated working solution. The concentrated working solution falls into a reservoir or is directed by a conduit to the wash tank of a washing apparatus. When the chemical compound within the container is completely utilized, the exhausted container is simply discarded and a fully charged container placed in the dispenser.

The use of solid cast detergents has presented great innovations to the dispensing of chemicals used in the cleaning process but additional features have been sought by users of solid block dispensers including (i) the ability to provide a relatively constant chemical dispensing rate, and (ii) a reduced unit cost of the chemical.

Containers utilized for storing and dispensing of solid chemicals used in cleaning processes depend upon the form of the solid detergent. Flaked or granular chemicals are typically packaged in sturdy paper board containers treated to prevent the passage of moisture into the package. Typically, the granular chemical is dispensed from the box by either (i) ripping a hole in the box or (ii) opening a reclosable spout provided on a side panel of the box. This type of container is unsuitable for nonflowing, solid block wash chemicals.

Containers for solid tablet or briquette chemicals used in cleaning processes typically take the form of paper or plastic wrappers which completely surround the tablet or briquette. The chemical is dispensed by removing the wrapper entirely and placing the tablet or briquette into the dispenser. The drawbacks associated with this type of container are: (i) they require physical contact of the skin with the chemical which should be avoided, and with some cleaning compositions such as highly alkaline compounds, can cause severe "burns", and (ii) the chemical must be formed in one step and packaged in a second step, requiring additional time and expense for packaging.

Solid, cast chemicals used in cleaning processes are preferably cast in a sturdy solid plastic container which can act as a mold, a shipping and storage container, and a dispenser housing. The cast chemical may be dispensed by inverting the container over a spray nozzle and impinging solvent directly into the container and onto the exposed surface or surfaces of the chemical contained therein.

Hazardous chemicals used in cleaning processes such as highly alkaline detergents are preferably packaged such that they can be dispensed without coming into physical contact with the human body. The paper and/or plastic wrappers typically utilized with tablet and briquette solid detergents are not adequate for this purpose as they require a large amount of handling to remove the wrapper and place the tablet or briquette into the dispenser after the wrapper has been removed.

Accordingly, a need exists for a dispensing apparatus which can simply, safely, efficiently and inexpensively dispense a homogeneous, uniform, concentrated chemical solution from a solid block of wash chemical at relatively constant concentrations and in certain applications, a need exists for an inexpensive solid block chemical container which minimizes the possibility of skin contact with the wash chemical; allows the solid wash chemical to be formed and packaged in a single step; and provides for a substantially constant rate of chemical dispensing.

SUMMARY OF THE INVENTION

The invention comprises a chemical dispenser for dispensing a concentrated chemical solution from a solid block of chemical for use in cleaning processes. The dispenser is configured in such a manner so as to maintain a relatively constant rate of dispensing by maintaining a constant distance between the dissolving spray nozzle and the exposed and erodable surface of the solid block of chemical.

The dispenser includes (i) a container surrounding the solid block of chemical, the solid block of chemical having at least one exposed surface; (ii) a spray means for directing a uniform spray such that the spray impinges at least one exposed surface of the solid block of chemical; and (iii) a means for maintaining a constant distance between the spray means and the exposed surface of the solid block of chemical to be sprayed in order to maintain a substantially constant chemical solution concentration during the entire lifetime of the solid block of chemical.

In more detail, the dispenser includes a housing suitable for fixed mounting to a solid mounting surface. The dispenser can be mounted vertically or horizontally, directly to a washing apparatus to which the concentrated chemical solution is to be supplied, adjacent to such washing apparatus, or at a position remote from such washing apparatus.

The housing can include (i) an upper storage portion for retainably holding a mass of solid block chemical; the storage portion having an upwardly disposed access port through which a solid block chemical is loaded into the housing; the access port normally covered by a door mounted onto the housing; and (ii) a lower collector portion configured in a funnel shape that downwardly converges to an outlet port. The housing is designed for mounting so that the vertical height of the outlet port from the collector portion of the housing can be higher than the utilization point. A conduit can then be connected to the outlet port of the housing for directing the chemical solution formed in the dispenser, by means of gravity feed, from the collector portion of the dispenser to its utilization point. Alternatively, the chemical solution may be pumped from the collector portion of the dispenser to its utilization point.

A three-dimensional, cylindrical support screen is retainably mounted within the housing, coupled to the housing at the points therein defining the intersection of the upper storage portion and the lower collector portion of the housing. The support screen extends upward into the storage portion of the dispenser and defines an annular cavity between the walls of the upper storage portion of the housing and the support screen such that a chemical container may envelop the support screen as the chemical held therein is utilized by dropping into the annular cavity. This maintains a vertically constant distance between the spray nozzle and the chemical which aids in maintaining a relatively constant rate of dispensing in this dispenser. The support screen supports the solid block of chemical only (not the chemical container) without significantly impeding access of a water spray onto the lower exposed surface of the chemical (e.g. screen size about 2.5 cm).

Spray forming means are axially mounted in the housing below the support screen. The spray forming nozzle is connected to a pressurized source of water by means of a water supply line. A spray control means comprising a valve in the water supply line controls the flow of water to the spray-forming nozzle. In operation, the valve normally blocks water flow to the nozzle and is operative to its open position only upon receipt of an external control signal. Upon receipt of such a control signal, the valve opens and water flow is allowed to flow through the supply line, and is dispersed by the spray forming means into engagement with substantially the entire lower surface of the chemical block supported immediately above the support screen. Spray from the nozzle is of relatively low pressure (typically 10 to 25 p.s.i.) and wets only that portion of the solid block chemical carried immediately above the support screen. The dissolved chemical passes in solution through the support screen, is directed by the underlying collector portion of the housing to the outlet port thereof and passes through a chemical solution conduit to its utilization point.

In an alternative embodiment a chemical solution pump in the chemical solution conduit is used to pump the chemical solution to its utilization point. The chemical solution pump is operative in response to a control signal to begin dispensing. A level indicator is positioned within the collector portion of the housing and operatively connected to the spray control means for controlling the flow of water to the nozzle. When the level of chemical solution in the collector portion of the housing decreases below a minimum level due to operation of the chemical solution pump, the level indicator is electronically closed and a control signal is sent to the spray control valve. Upon receipt of such a control signal the spray control valve opens to the flow of water therethrough and additional chemical solution is formed until the level indicator indicates that the minimum level has been achieved. The rate of creation of chemical solution should be greater than the rate at which chemical solution is pumped out of the collector portion of the housing to prevent the entrainment of air. Also, the minimum level of chemical solution should be set below the nozzle to prevent any interference with the spray of water. This type of dispenser is particularly useful when introducing the chemical solution into a pressurized line or tank or into a remote utilization point and prevents the entrainment of air into the pump and early pump failure.

Optionally, a $\frac{1}{4}$ to 1/20 inch (0.64 to 0.13 cm) lower screen can be placed in the collector portion of the housing between the spray nozzle and the outlet port to catch any undissolved chunks of chemical which have broken away from the main block and which are small enough to pass through the support screen. This prevents small chunks of chemical from collecting in the outlet port or the conduit connected thereto and blocking the flow of concentrated chemical solution out of the dispenser.

An electrically or mechanically actuated safety control switching circuit can be connected to sense the operative position of the door covering the access port to the housing and prevent water spray from the nozzle whenever the door is not in its closed position overlying the access port. This prevents the spray of concentrated chemical solution while an operator is loading the dispenser.

While the present invention will be described in combination with a particular configuration of the dispenser housing, it will be understood that other configurations could be designed within the spirit and scope of this invention. Further, while the preferred embodiment of the invention will be described in combination with specific electronic control modules for providing control signals to the spray control means regulating water flow to a spray nozzle, it will be understood that other control circuits, including mechanical, hydraulic, and optical systems, could equally well be configured within the spirit and scope of this invention. Similarly, while specific switching circuits and techniques will be described with respect to the preferred embodiments of this invention, other safety control means including purely mechanical linkage systems could equally well be devised within the scope of this invention. Further, while specific configurations of the support screen and container are described, other alternative configurations may be used in accordance with this invention so long as the container is capable of passing between the walls of the housing and the support screen so as to maintain a constant distance between the chemical and the spray forming means as the chemical is utilized (e.g. an oval or square, instead of circular, container and support screen).

The solid block of wash chemical is housed in a sturdy container having at least one exposed surface and a removable cap or lid enclosing the exposed surface(s) before use.

The chemical may be cast or compressed directly into the container with the cap or lid attached to the container by means of a threaded fitting, a friction fitting, adhesive, etc. preferably a sturdy, thermoplastic, threaded cap is securely attached to the container, completely enclosing the chemical contained therein from environmental effects. At the point of use, the cap or lid is removed, the container inverted over the access port of the dispenser and the chemical placed onto the support screen; the support screen contacting only the chemical within the container.

As used herein, the term "utilization point", when used in combination with chemical solution, refers to the place where the solution is used such as a wash tank, a spray rinse nozzle, etc.

As used herein, the term "chemical" refers to those chemical compounds or mixtures commonly added to aqueous liquids present in machine washing units to aid in the cleaning and rinsing of fabrics and wares. Such chemicals include detergents, softeners, bleaches, rinse aids, etc.

DESCRIPTION OF THE PREFERRED EMBODIMENTS

Figure 1:
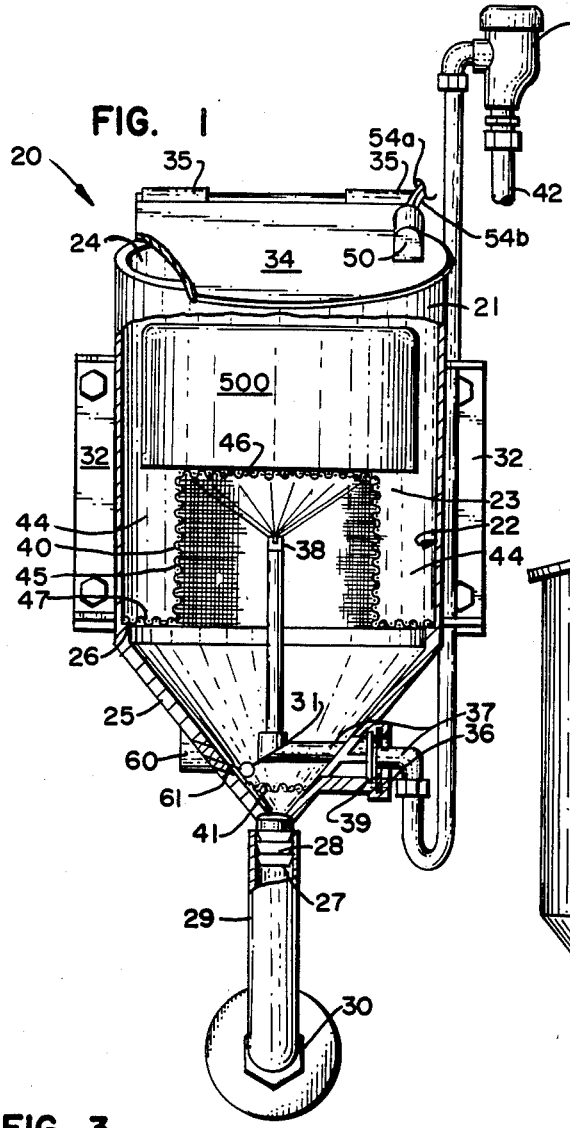
FIG. 1 is a front view, with portions thereof broken away, of one embodiment of the dispenser of this invention.

Referring to the Figures, there is generally disclosed at 20 a housing. The housing has a generally cylindrical upper storage portion 21 having a cylindrical inner wall 22. The wall 22 defines an internal cavity 23. The upper terminous of the storage portion 21 defines an access port 24 into cavity 23 of storage portion 21.

Inner wall 22 of housing 20 converges in the downward direction, defining a lower funnel-shaped collector portion 25 of housing 20. Inner wall 22 of housing 20 is configured to form an annular flange 26 circumferentially extending around inner wall 22 of housing 20 at the juncture of upper storage portion 21 and lower collector portion 25. The lower terminous of collector portion 25 defines an outlet port 27 from internal cavity 23 for passage therethrough of solution collected by collector portion 25. Outlet port 27 has a hose clamp extension 28 having a plurality of annular ribs configured for engaging the inner walls of a connecting hose or conduit 29.

The outlet port 27 may be directly connected with a utilization point by conduit 29. The chemical solution created may be fed to the utilization point by gravity flow or by means of a solution pump 30.

Housing 20 may be constructed of any suitable material which is capable of withstanding exposure to highly caustic solutions, and is preferably configured of stainless steel or molded plastic material.

A pair of mounting plates 32 are connected to and extend rearwardly from the outer surface of housing 20 for securely mounting housing 20 to a sturdy surface, generally designated as 100. A brace member 33 extends across the back surface of housing 20, connecting the pair of mounting plates 32 and adding structural support to the dispenser housing 20.

A door 34 is sized to completely cover and sealingly engage access port 24. The door 34 is pivotally mounted to the brace member 33 at 35 for pivotal motion between a closed position, illustrated in full line in FIG. 2, to an open position, illustrated in dashed lines in FIG. 2.

An outwardly projecting coupling portion 36 extends from the side of collector portion 25. A tube fitting insert 37 is secured within coupling projection 36 and projects through inner wall 22 of collector portion 25 of housing 20. A spray-forming nozzle 38 is threaded into the end of tube insert 37 and is axially aligned within inner cavity 23 of housing 20 in a direction so as to direct an upwardly projected spray pattern therefrom. Tube fitting insert 37 is provided with an O-ring seal 39.

A three-dimensional, cylindrical, upwardly extending support screen 40 is mounted in resting engagement upon flange 26 of housing 20. Support screen 40 preferably has about 0.3 to 7.5 cm, most preferably about 2.5 cm square openings in order to support a container 500 of chemical 80 without significantly interfering with the impingement of water sprayed from nozzle 38 onto the exposed surface 81 of the chemical block 80 which contacts support screen 40. The support screen 40 extends inwardly with support and extension portion 47 and then upwardly from flange 26 into storage portion 21 of housing 20 with a wall 45 thereby defining an annular generally elongated torroidal cavity 44 between the inner wall 22 of housing 20 and the vertical wall 45 of support screen 40. Cavity 44 has sufficient size to allow passage of the container walls 506 between inner wall 22 of housing 20 and vertical wall 45 of support screen 40 as the block of chemical 80 is used. The height of support screen 40 is determined by the depth of container 500 to be utilized in the dispenser. Preferably the support screen 40 extends about 15 to 30 cm into storage portion 21 and defines a 0.6 to 2.5 cm wide torroidal cavity 44 in conjunction with inner wall 22 of housing 20. The support screen 40 terminates in a substantially flat horizontal screen 46 whereupon the solid block of chemical 80 (but not container 500) is directly supported. Support screen 40 maintains surface 81 of the chemical 80 at a constant vertical or distance from spray nozzle 38 during use of the entire chemical block 80. Container 500 passes into the generally elongated torroidal cavity 44 as the chemical block 80 is used. By maintaining the chemical block 80 at a constant vertical height the distance between the dissolving spray nozzle 38 and the exposed and erodable surface 81 of the chemical block 80 remains constant which, as I have discovered, aids significantly in maintaining a constant rate of dispensing.

A lower screen 41 having about 0.63 to 0.13 cm openings may be placed in collector portion 25 of housing 20 between spray nozzle 38 and outlet port 27 to catch any undissolved chunks of chemical 80 which break away from the chemical block 80 and which are small enough to pass through support screen 40. This prevents small chunks of chemical 80 collecting in outlet port 27 or conduit 29 and blocking the flow of concentrated chemical solution out of dispenser 20.

Figure 2:
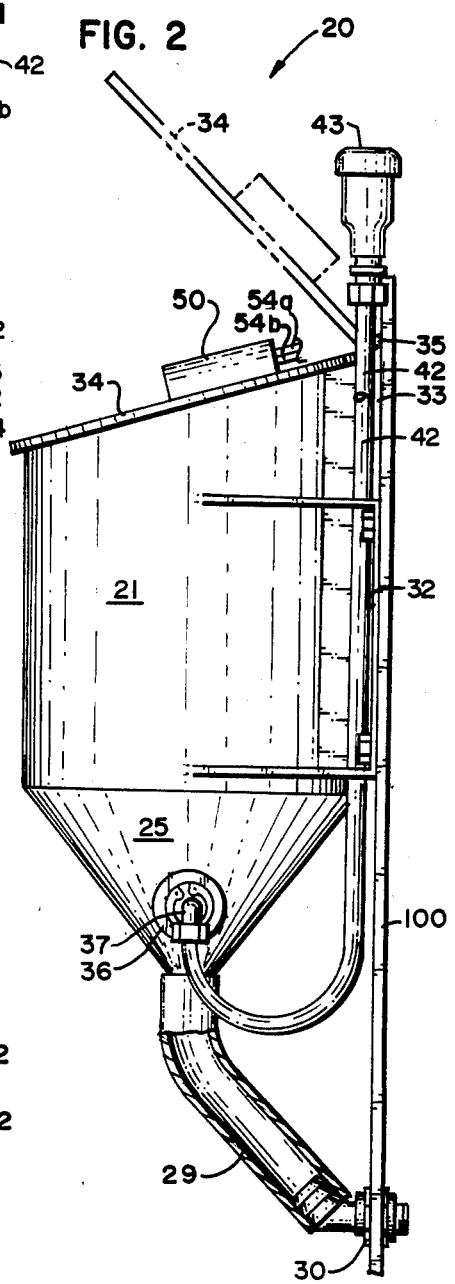
FIG. 2 is a side view of the dispenser disclosed in FIG. 1 without the optional chemical solution pump.
Figure 3:
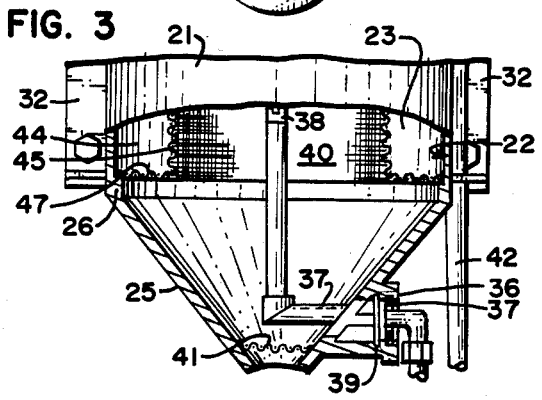
FIG. 3 is an enlarged front view, with portions thereof broken away, of the collector portion of the dispenser shown in FIG. 2.
Figure 4:
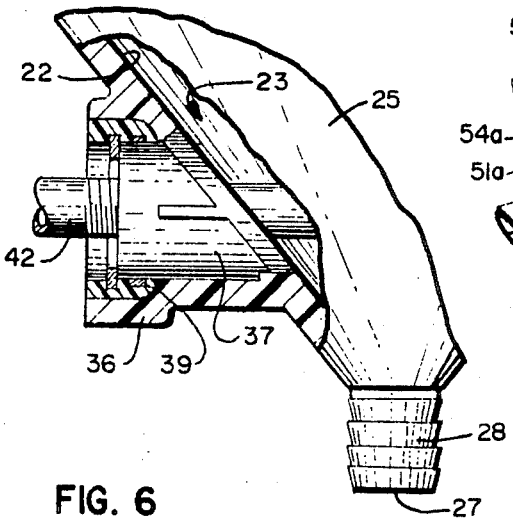
FIG. 4 is an enlarged fragmentary back view, with portions thereof broken away, of the lower portion of the collector portion of the dispenser shown in FIG. 2.

A water supply inlet pipe 42 is connected to tube insert 37 and is in communication therewith for providing a source of water flow to spray-forming nozzle 38. Water supply line 42 may be configured to pass through one of the mounting plate members 32, as illustrated in FIGS. 1 and 2, to receive structural support therefrom. A siphon breaker 43 interrupts water supply line 42 for controlling the flow of water to nozzle 38.

Figure 5:
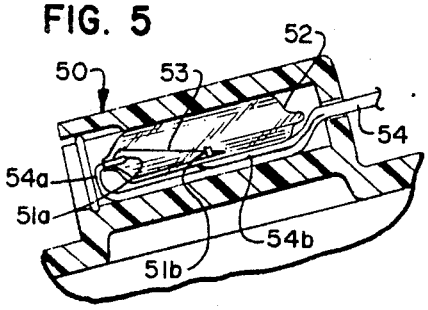
FIG. 5 is an enlarged cross-sectional view of the safety control switch mounted upon the door of the dispenser shown in FIG. 2.
Figure 5A:
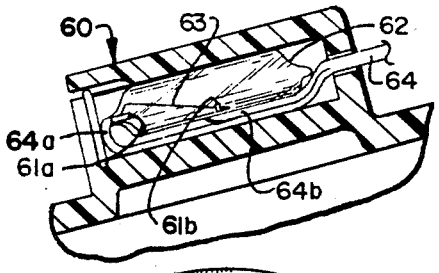
FIG. 5*a* is an enlarged cross-sectional view of the level indicator switch shown in FIG. 1.
Figure 8:
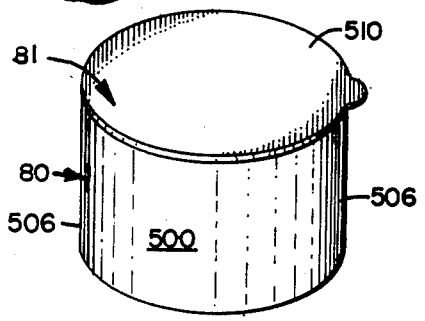
FIG. 8 is a perspective view of the container of this invention.
Figure 9:
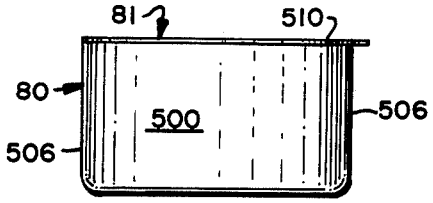
FIG. 9 is a front view of the container of FIG. 8.

In the embodiment utilizing the chemical solution pump 30, the pump 30 is operative in response to a control signal. A float 31 is positioned within collector portion 25 of housing 20 and is operatively connected by float extension bar 61 to level indicator switch 60. When the level of chemical solution in collector portion 25 of housing 20 falls below a minimum level due to operation of chemical pump 30, level indicator switch 60 is electrically closed by the downward motion of float 31 and proportional change in the slope of float extension bar 61. An electrical signal is then allowed to pass through level indicator switch 60 onto spray control means 43 and spray control means 43 is opened to the flow of water therethrough. Chemical solution is then formed until float 31 rises to or above the minimum level wherein level indicator switch 60 is electrically opened. Level indicator switch 60 is in communication with float extension bar 61 for sensing the operative angle of float extension bar 61; the angle of float extension bar 61 changing in proportion with the change in height of float 31. In the preferred embodiment, level indicator switch 60 comprises a mercury actuated switch, diagramatically illustrated in FIG. 5*a*. Referring thereto, level indicator switch 60 generally has a pair of contacts 61*a* and 61*b* projecting within an insulating bulb 62 which entraps a fluid conductive medium 63 such as mercury. Level indicator switch 60 is mounted upon float extension bar 61 such that when float extension bar 61 is operatively positioned so as to indicate the level of chemical solution in collector portion 25 is at or above the minimum level, mercury 63 does not provide an electrical shorting path between first and second terminals 61*a* and 61*b* of switch 60 and the float switch 60 is electrically open. When float 31 is lowered due to a decrease in the amount of chemical solution in collector portion 25, the angle of float extension bar 61 is pivotally altered and the mercury 63 flows within bulb 62 to engage both the first and second terminals 61*a* and 61*b* so as to provide an electrical circuit path between the first and second terminals 61*a* and 61*b*, thus electrically closing float switch 60. Conduction paths are provided from first and second terminals 61*a* and 61*b* by means of a pair of conductor members 64*a* and 64*b* respectively, conduction member 64*a* coupled to a power source 201 and conduction member 64*b* coupled to first terminal 51*a* of safety switch 50 when safety switch 50 is used; and to spray control means 43 when safety switch 50 is not used.

This type of dispenser is particularly useful when introducing the chemical solution into a pressurized line or tank or to a remote utilization point. It prevents the entrainment of air into wash chemical pump 30 and early failure of the pump 30.

A safety switch 50 is mounted to door 34 for movement therewith and senses the operative position of door 34 relative to access port 24 of housing 20. In the preferred embodiment, safety switch 50 comprises a mercury actuated switch, diagrammatically illustrated in FIG. 5. Referring thereto, safety switch 50 generally has a pair of contacts 51*a* and 51*b* projecting within an insulating bulb 52 which entraps a fluid conductive medium 53 such as mercury. Switch 50 is mounted upon door 34 such that when door 34 is operatively positioned so as to close external access to the internal cavity 23 of housing 20, the mercury 53 provides an electrical shorting path between first and second terminals 51*a* and 51*b* of switch 50. When door 34 is pivotally open so as to enable access to internal cavity 23 of housing 20, the mercury 53 flows within bulb 52 away from engagement with the first terminal 51*a* so as to break the electrical circuit path between first and second terminals 51*a* and 51*b*, thus electrically opening safety switch 50. Conduction paths are provided from first and second terminals 51*a* and 51*b* by means of a pair of conductor members 54*a* and 54*b* respectively, conduction member 54*a* coupled to second terminal 61*b* of float switch 60 when solution pump 30 is used and to a power sourced 201 when solution pump 30 is not used; and conduction member 54*b* coupled to spray control means 43.

Figure 6:
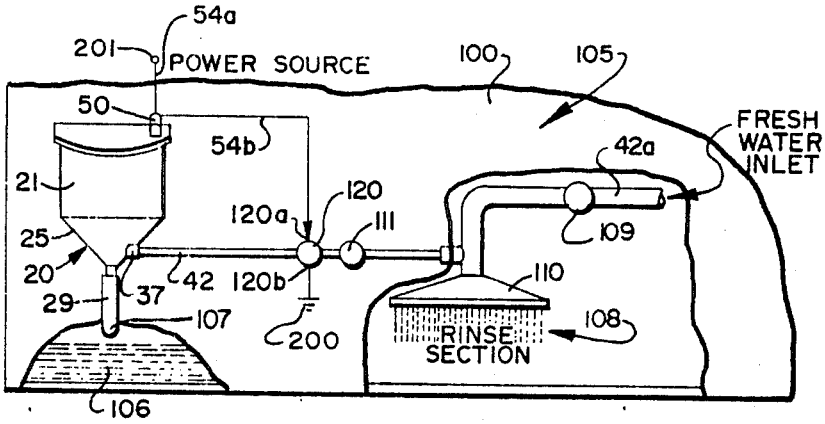
FIG. 6 is a schematic block diagram illustrating the circulatory and basic electrical signal flow paths for one embodiment of the dispenser of this invention.

A block diagram of the circuit and fluid flow paths for the dispenser apparatus as connected within a hydraulic, manually controlled gravity feed system is illustrated in FIG. 6. Referring thereto, dispenser housing 20 is illustrated as mounted to a side wall 100 of a washing machine 105. Washing machine 105 has a wash tank 106 for storing a supply of detergent solution for use within the machine. Conduit 29 extends from outlet port 27 of housing 20 and is connected to a hose clamp extension 107 extending through side wall 100 of washing machine 105 and terminating at a position directly overlying wash tank 106. Washing machine 105 also has a fresh water supply line 42*a* connected to a pressurized source of water (not illustrated). Water line 42*a* directly provides clean rinse water to the rinse section 108 of wash machine 105 and branches out to water supply line 42 for providing fresh water to spray-forming nozzle 38 as well. A rinse valve 109, either manually or electronically controlled, is connected to water supply line 42*a* at a position upstream from the rinse head 110 and upstream from the input to water supply line 42 for controlling the flow of water to rinse head 110 and water supply line 42. A flow control valve 111 is connected in water supply line 42 leading to spray-forming nozzle 38 to regulate the rate of flow of water to spray-forming nozzle 38. A safety control valve 120 is connected in the water supply line 42. The safety control valve 120 is, in the preferred embodiment, a solenoid actuated valve having an input control terminal 120*a* and a common terminal generally designated at 120*b*. The common terminal 120*b* is directly connected to a reference potential generally designated at 200.

The first conductor 54*a* leading from the safety switch 50 is directly connected to an appropriate power source 201. The second conductor 54*b* leading from the safety switch 50 is directly connected to the control input terminal 120*a* of the solenoid actuated safety control valve 120.

Control of the dispensing of the chemical block 80 from dispenser 20 is done by controlling the flow of water to spray nozzle 38. This may be done in a number of ways including mechanical means such as hydraulic timer valves and electrical means such as electrical switching within the washing machine control system (not illustrated), conductivity sensing means in wash tank 106, and electrical timers.

Figure 6A:
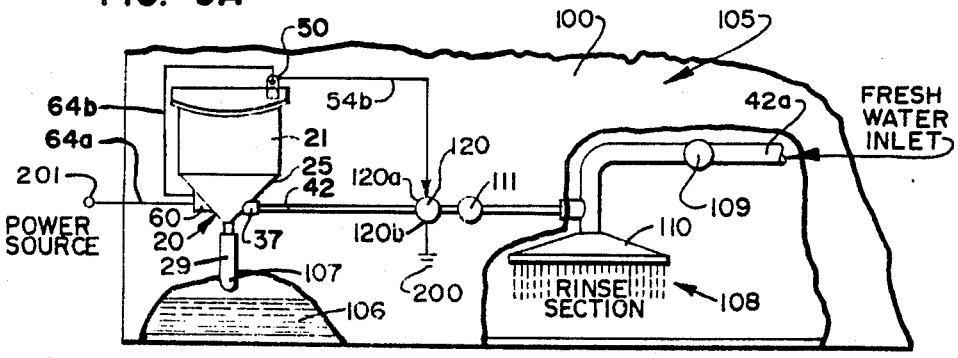
FIG. 6*a* is a schematic block diagram illustrating the circulatory and basic electrical signal flow paths for a second embodiment of the dispenser of this invention which utilizes a chemical solution pump and a level indicator switch.

As shown in FIG. 6*a*, when the alternative embodiment of dispenser 20 utilizing the chemical solution pump 30 is used, the power source 201 is connected via conductor 64*a* to the input terminal 61*a* of float switch 60. Conductor 64*b* then connects float switch 60 with the input terminal 51*a* of safety switch 50 and conductor 54*b* connects the output terminal 51*b* of the safety switch 50 with the input terminal 120*a* of the safety control valve 120. In use the safety control valve 120 is normally closed to water flow therethrough. The power to open safety control valve 120 and allow the flow of water to spray nozzle 38 reaches valve 120 only if the float switch 60 is in its electronically closed state (level of chemical solution below the minimum level) and safety switch 50 is in its electronically closed state (door 34 closed).

For purposes of illustration, a dispenser system utilizing a conductivity sensing means to control the flow of water to spray nozzle 38 will be described.

Figure 7:
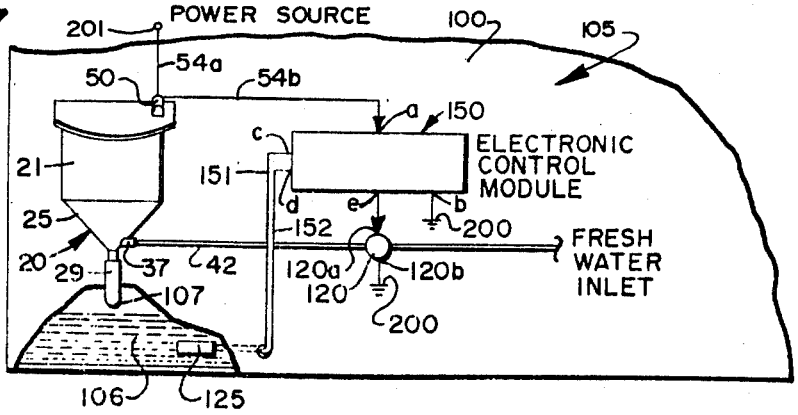
FIG. 7 is a schematic block diagram illustrating the circulatory and basic electrical signal flow paths for a third embodiment of the dispenser of this invention which utilizes conductivity sensing means in the wash tank to regulate operation of the dispenser.

Referring to FIG. 7, housing 20 is illustrated as mounted to side wall 100 of a washing machine 105 at a position above wash tank 106 of washing machine 105 such that conduit 29 and associated hose connecting extension 107 dispense the contents of collector portion 25 of housing 20 directly into reservoir 106. Water supply line 42 is directly connected to a source of pressurized water (not illustrated). Solenoid safety control valve 120 is connected in water supply line 42 between spray-forming nozzle 38 and the water supply source. Solenoid valve 120 has an input control terminal 120*a* and a common terminal 120*b* which is directly connected to a ground potential 200.

First conductor 54*a* leading from safety switch 50 is directly connected to a power source 201. Second conductor 54*b* leading from safety switch 50 is connected to a positive power supply input terminal 150*a* of an electronic control module 150. Electronic control module 150 further has a reference supply input terminal 150*b* which is directly connected to common potential 200, a first signal input terminal 150*c*, a second signal input terminal 150*d*, and a signal output terminal 150*e*. Signal output terminal 150*e* of electronic control module 150 is directly connected to control input terminal 120*a* of solenoid valve 120. First and second signal input terminals 150*c* and 150*d* of electronic control module 150 are directly connected by means of a pair of signal flow paths 151 and 152 respectively to terminals of a conductivity cell 125. Conductivity cell 125 is mounted within reservoir 106 of washing machine 105 for sensing the electrical conductivity of the solution contained therein.

An example of an electronic control module 150 which may be utilized in the present invention is disclosed in U.S. Pat. No. 3,680,070, issued to Markus I. Nystuen. In general, the electronic control module 150 is normally operable to provide a de-energizing signal output at its output terminal 150*e* when conductivity cell 125 indicates the conductivity (i.e. the chemical concentration level) of the wash tank solution within wash tank 106 is at or above a predetermined level and is operable to provide an energizing output signal at its signal output terminal 150*e* whenever conductivity cell 125 indicates that the conductivity (concentration level) of the solution within reservoir 106 has dropped below a predetermined minimum level. The signal output appearing at output terminal 150*e* of electronic control module 150 is used to energize input control terminal 120*a* of solenoid valve 120. The circuits within electronic control module 150 are energized from power source 201 by means of the serially connected safety switch 50. Therefore, whenever the safety switch 50 is operative in a non-conducting (open) mode, electronic control module circuits will be disabled, preventing passage of an energizing signal to solenoid valve 120, regardless of the conductivity indication status of conductivity cell 125.

Conductivity cell 125 may be of any type of such cell well known in the art, which provides an electrical output signal that varies in response to the electrical conductivity of the solution in which it is immersed.

It will be understood that other solenoid valve 120 activation and deactivation systems and indeed purely mechanical control systems could be used to control the flow of water to spray nozzle 38 and thereby control the dispensing of chemical, within the spirit and scope of this invention.

For use in the dispenser of this invention the solid block of chemical used in cleaning processes is packaged in an open faced, sturdy container 500 having a cross-sectional area such that the container may easily pass into torroidal cavity 44 as the chemical 80 contained therein is used. The open face is covered with a sturdy thermoplastic threaded cap 510. The cross-sectional area of container 500 must be slightly greater than the cross-sectional area of the horizontal portion 45 of support screen 40. This is necessary to allow the container 500 to pass easily around support screen 40 and into torroidal cavity 44.

The container 500 may be made of any sturdy material capable of preventing the passage of the chemical into the surrounding atmosphere. Examples of such materials include stainless steel, glass, and thermoplastic such as polyethylene and polypropylene.

At the point of use, the cap 510 is removed, the container 500 inverted over the access port 24 of the dispenser 20 and the container 500 and chemical block 80 contained therein is placed with surfaces 81 of chemical block 80 contacting the horizontal portion 45 of the support screen 40. Door 34 is then placed in a closed position over the access port 24.

OPERATION OF THE PREFERRED EMBODIMENT

Operation of the dispensing apparatus of this invention is relatively simple and is briefly described below with reference to FIG. 6. A container 500 containing a block of solid chemical 80 is loaded into upper storage portion 21 of housing 20 through access port 24 by removing cap 50, inverting container 500, open face 501 down, directly over access port 24 and placing container 500 and chemical 80 onto the horizontal portion 45 of support screen 40. The container walls 506 will extend around support screen 40 such that only the block of chemical 80 contained within the container 500 will contact the support screen 40. As the chemical 80 is used the container 500 will envelop the support screen 40 by passing into torroidal cavity 44. This maintains a constant distance between nozzle 38 and the exposed, dissolving surface 81 of the solid block of chemical 80, thereby maintaining a substantially constant rate of dispensing.

When door 34 is raised out of sealing engagement overlying access port 24, the mercury 53 within safety switch 50 will be disposed within insulating bulb 52 of safety switch 50 so as to electrically open the signal path between first and second terminals 51*a* and 51*b* of the safety switch 50. Solenoid valve 120 is connected so as to be open to fluid flow while in receipt of an energizing signal from the safety switch 50. However, when signal flow to solenoid valve 120 is blocked by means of open safety switch 50, solenoid valve 120 will close, blocking further fluid flow to spray-forming nozzle 38. Under normal operation, a fluid flow path is established from the water source through water supply line 42 to spray-forming nozzle 38 whenever rinse valve 109 is opened, either electronically or manually. When provided with fluid flow therethrough, spray-forming nozzle 38 will direct a spray pattern at the bottom surface of support screen 40, wetting that chemical 80 carried immediately thereabove 81, which dissolves and passes in solution through support screen 40 to collector portion 25 of housing 20. Thus, concentrated chemical solution is produced in this arrangement of the apparatus, whenever rinse valve 109 is opened and door member 34 is closed so as to enable safety switch 50. The concentrated detergent solution passes through outlet port 27 of housing member 20 and is directed by conduit 29 to its utilization point.

CHEMICAL COMPOSITIONS

Disclosed below in Examples I through VI is a non-exhaustive list of chemical compositions which may be cast or compressed into solid blocks 80 and utilized in the dispenser of this invention.

EXAMPLE I

| High Alkaline Industrial Laundry Detergent | |
|---|---|
| Raw Material | Wt % |
| Sodium hydroxide - 50% | 26.00 |
| Dequest 2000[1] | 17.00 |
| Polyacrylic acid - 50% M.W. 5000 | 6.50 |
| Nonylphenol ethoxylate 9.5 mole ratio | 14.00 |
| Tinopal CBS[2] | 0.075 |
| Sodium hydroxide | 36.425 |
| | 100.0 |

[1]Trademark - Monsanto Chemical Co.
[2]Trademark - Ciba-Giegy

All ingredients except the sodium hydroxide were mixed together and melted at a temperature of about 170° F. The sodium hydroxide was then added and mixed until a uniform product was obtained. The product was poured into a container and cooled.

EXAMPLE II

| Institutional Dishwashing Detergent | |
|---|---|
| Raw Material | Wt % |
| Sodium hydroxide 50% solution | 50.0 |
| Sodium hydroxide bead | 25.0 |
| Sodium tripolyphosphate | 25.0 |
| | 100.0 |

The sodium hydroxide bead was added to the sodium hydroxide 50% solution, heated to 175° F. and mixed. The sodium tripolyphosphate was then added and mixed until uniform, about 10 to 20 minutes. This mixture was poured into a container and cooled rapidly to solidify the product.

EXAMPLE III

| Solid Rinse Aid | |
|---|---|
| Raw Material | Wt % |
| Polyethylene glycol (M.W. 8000) | 30.0 |
| Sodium xylene sulfonate | 20.0 |
| Pluronic[1] L62 | 40.0 |
| Pluronic[1] F87 | 10.0 |
| | 100.0 |

[1]BASF Wyandotte trademark for ethyleneoxide-propyleneoxide block copolymers.

The polyethylene glycol was melted at a temperature of about 160° F. The sodium xylene sulfonate granules or flakes were added and mixed into the polyethylene glycol melt. Pluronic L62 and F87 were then added and mixed until the melt was uniform, about 10 to 20 minutes. The mixture was then poured into a container and allowed to cool and solidify.

EXAMPLE IV

| Neutral Hard Surface Cleaner | |
|---|---|
| Raw Material | Wt % |
| Nonyl phenol ethoxylate 15 moles of ethylene oxide | 80.0 |
| Polyethylene oxide M.W. 8000 | 20.0 |
| | 100.0 |

The nonyl phenol ethoxylate 15 moles of ethylene oxide and polyethylene oxide were mixed together and melted at a temperature of about 160° to 180° F. The product was then poured into a container and cooled below its melting point of about 150° F.

EXAMPLE V

| Laundry Detergent (Low Alkalinity) | |
|---|---|
| Raw Material | Wt % |
| Polyethylene oxide M.W. 8000 | 25.40 |
| Neodol 25-7, Linear Alcohol Ethoxylate(1) | 30.0 |
| Dimethyl distearyl ammonium chloride | 3.0 |
| Tinopal CBS, Optical Dye(2) | 0.1 |
| Carboxymethyl cellulose | 1.5 |
| Sodium tripolyphosphate | 35.0 |
| Sodium metasilicate | 5.0 |
| | 100.0 |

(1)Trade name - Shell Chemical Co.
(2)Trade name - Ciba Giegy

The polyethylene oxide and the dimethyl distearyl ammonium chloride were mixed together and melted at a temperature of about 160° to 180° F. The remaining items were then added to the hot melt and mixed until a uniform product was obtained, about 10 to 20 minutes. The mixed product thusly obtained was then poured into a container and cooled below its melting point of about 140° F.

One thousand, three hundred grams of sodium hydroxide was placed in a 4 liter glass beaker and heated under agitation to about 190°-200° F. Eight hundred, fifty grams of Dequest 2000 and 325 grams of 50% solution polyacrylic acid, molecular weight 5,000 were slowly added to the 50% sodium hydroxide solution contained in the glass beaker. Six hundred, ninety grams of nonylphenol ethoxylate, 9.5 mole ratio, 4 grams of Tinopal CBS, and 1,831 grams of sodium hydroxide were added together and heated to about 180°-190° F. The two melts were then combined in the beaker and agitated for about 30 minutes. The solution was slowly cooled under constant agitation to about 160° F. The product was then poured into a plastic package and sealed.

EXAMPLE VI

| Solid Sour Soft | |
|---|---|
| Raw Material | Percent |
| Arosurf TA-100[1] | 12 |
| Hexylene glycol | 13 |
| Sokalan DCS[2] | 75 |

[1]Trademark, Sherex Chemical Company (distearyl dimethyl ammonium chloride)
[2]Trademark, BASF Germany (mixture of succinic, adipic and glutaric acids)

Five hundred, twenty grams of hexylene glycol and 480 grams of Arosurf TA-100 were placed in a 4 liter glass beaker and heated to 180°-190° F. to melt the Arosurf TA-100. This melt was maintained at 190°-200° F. and constantly agitated while 3,000 grams of Sokalan DCS was added. After addition of the Sokalan DCS the mixture was agitated for 30 minutes to ensure a homogeneous mixture, poured into a plastic package and sealed.

The compositions described in Examples I and II are most favorably dispensed in the dispenser of this invention because contact with these highly alkaline products can be harmful.

Other modifications of the invention will be apparent to those skilled in the art in light of the foregoing description. This description is intended to provide concrete examples of individual embodiments clearly disclosing the present invention. Accordingly, the invention is not limited to these embodiments or to the use of specific elements therein. All alternative modifications and variations of the present invention which fall within the spirit and broad scope of the appended claims are covered.

EXAMPLE VII

Two identical cylindrical containers having a diameter of about 15 cm and a height of about 17.5 cm were filled with about 5,000 grams of Tri-Star detergent as described in Example I. The containers were allowed to cool to room temperature before dispensing.

One of the containers was placed in the dispenser of this invention which maintained a constant distance of about 8 cm between the spray nozzle and the exposed erosion surface of the detergent as the detergent was consumed. The other container was placed in a dispenser similar to the dispenser of this invention except that the support screen was a flat horizontal screen which did not allow the container to descend as the detergent was consumed. Therefore, the distance between the spray nozzle and the exposed erosion surface of the detergent increased from about 8 cm to about 25 cm as the detergent was consumed.

A dispensing cycle was then established for both dispensers whereby water maintained at a temperature of about 128°-131° F. was sprayed at a pressure of about 20 psi onto the exposed erosion surface of the detergent for a period of 35 seconds every 20 minutes. At random points in the dispensing cycle the amount of detergent dispensed during a 35 second spray was measured by weighing the container immediately before and after the spray.

Figure 10:
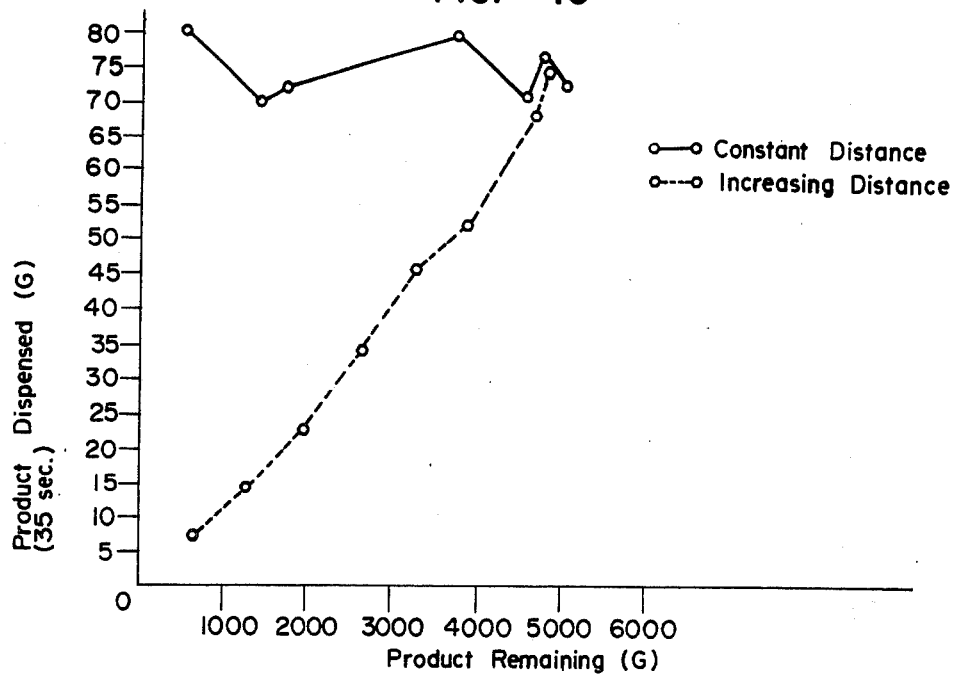
FIG. 10 is a graphical comparison of the concentration of the chemical solution dispensed from a constant nozzle to chemical distance dispenser of the invention versus an increasing nozzle to chemical distance dispenser.

The results of the experiment are tabulated in Table 1 and graphically depicted in FIG. 10. As is clearly shown in FIG. 10, the concentration of the detergent solution dispensed from the increasing distance dispenser substantially decreases as the detergent is consumed, with about a 10:1 change in the number of grams of detergent dispensed in a 35 second spray during consumption of the detergent. In contrast, the concentration of the detergent solution dispensed from the constant distance dispenser of this invention remains relatively constant during the consumption of the detergent.

TABLE 1

| High Alkaline Industrial Laundry Detergent Constant Distance (Nozzle to Detergent) | | |
|---|---|---|
| Weight of Detergent before 35 Second Spray (g) | Weight of Detergent after 35 Second Spray (g) | Detergent Dispensed in 35 Seconds (g) |
| 5000 | 4928 | 72 |
| 4759 | 4683 | 76 |
| 4552 | 4481 | 71 |
| 3726 | 3647 | 79 |
| 1731 | 1659 | 72 |
| 1408 | 1338 | 70 |
| 521 | 441 | 80 |
| Increasing Distance (Nozzle to Detergent) | | |
| 4825 | 4751 | 74 |
| 4651 | 4583 | 68 |
| 3856 | 3804 | 52 |
| 3243 | 3197 | 46 |
| 2619 | 2585 | 34 |
| 1956 | 1933 | 23 |
| 1257 | 1243 | 14 |

TABLE 1-continued

| | | |
|---|---|---|
| 641 | 634 | 7.0 |

EXAMPLE VIII

Figure 11:
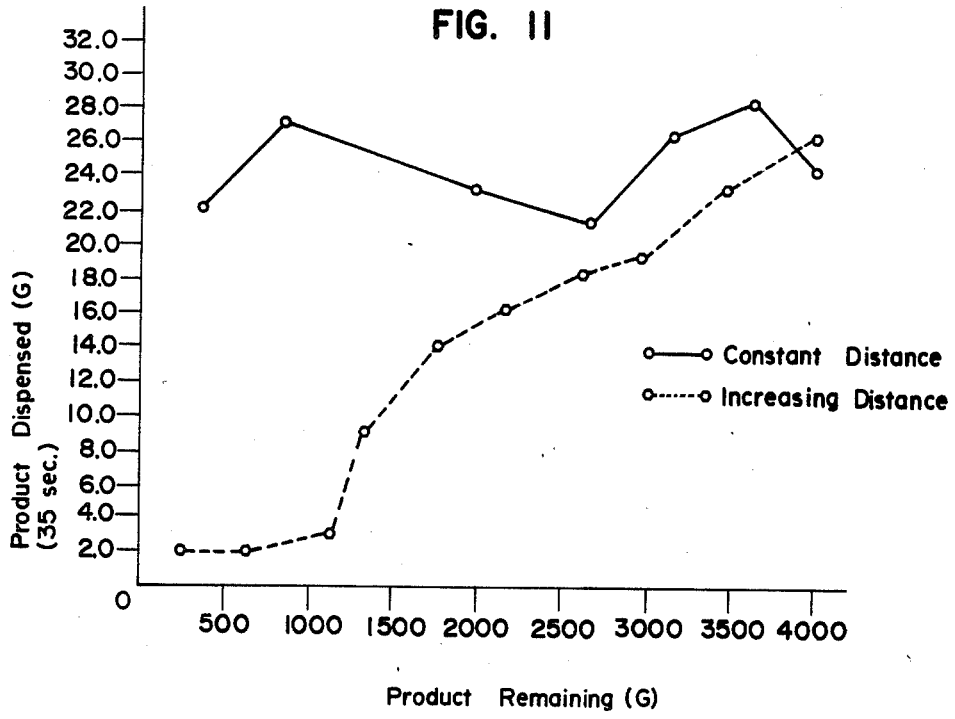
FIG. 11 is a graphical comparison of the concentration of the chemical solution dispensed from a constant nozzle to chemical distance dispenser of the invention versus an increasing nozzle to chemical distance dispenser.

Example VII was repeated using the Solid Sour Soft of Example VI in place of the High Alkaline Institutional laundry detergent. The results of the experiment are tabulated in Table 2 and graphically depicted in FIG. 11. As is clearly shown in FIG. 11, the concentration of the sour/soft solution dispensed from the increasing distance dispenser substantially decreases as the sour/soft is consumed, with about a 10:1 change in the number of grams of softener dispensed in a 35 second spray during consumption of the sour/soft. In contrast, the concentration of the sour/soft solution dispensed from the constant distance dispenser remains relatively constant during the entire consumption of the sour/soft.

TABLE 2

| Solid Sour Soft | | |
|---|---|---|
| Constant Distance (Nozzle to Detergent) | | |
| Weight of Detergent before 35 Second Spray (g) | Weight of Detergent after 35 Second Spray (g) | Detergent Dispensed in 35 Seconds (g) |
| 4000 | 3976 | 24 |
| 3611 | 3583 | 28 |
| 3147 | 3121 | 26 |
| 2652 | 2631 | 21 |
| 1971 | 1948 | 23 |
| 841 | 814 | 27 |
| 351 | 329 | 22 |
| Increasing Distance (Nozzle to Detergent) | | |
| 3982 | 3956 | 26 |
| 3464 | 3441 | 23 |
| 2951 | 2932 | 19 |
| 2617 | 2599 | 18 |
| 2159 | 2143 | 16 |
| 1762 | 1748 | 14 |
| 1337 | 1328 | 9 |
| 1124 | 1119 | 5.0 |
| 634 | 632 | 2.0 |
| 251 | 249 | 2.0 |

I claim:

1. A dispenser for dispensing an aqueous chemical solution of substantially constant concentration from a solid.block of chemical retained within a container; the chemical retained within the container such that the chemical and container move as a single unit during dispensing, which comprises:

(a) a spray means for directing a uniform solvent spray such that the solvent impinges an exposed surface of the solid block of chemical; and means for supporting the solid block of chemical which, during dispensing of the entire solid block of chemical, maintains a constant distance between the spray means and the exposed surface of the solid block of chemical while the distance between the spray means and the container decreases.

2. The dispenser of claim 1 further comprising a housing surrounding the container and spray means for containing, collecting, and directing the chemical solution formed therein.

3. A dispenser for dispensing an aqueous chemical solution of substantially constant concentration from a solid block of chemical retained within a container, which comprises:

(a) a fixed position spray means for directing a uniform solvent spray such that the solvent impinges an exposed surface of the solid block of chemical;

(b) a housing, having a central axis, surrounding the container and spray means for containing, collecting and directing the chemical solution formed therein; and (c) a means for maintaining a constant distance between the spray means and the exposed surface of the solid block of chemical which comprises a three-dimensional screen having:

(i) a lower, substantially horizontal, circumferential support and extension portion in supportable contact with the housing and extending towards the central axis of the housing;

(ii) a substantially vertical circumferential wall integrally coupled with the lower support and extension portion; the circumferential wall extending away from the spray means and defining a generally longitudinally elongated, annular cavity between the housing and the wall; and (iii) a substantially flat horizontal top portion integrally coupled with the wall for supporting the exposed surface of the solid block of chemical; wherein the container is allowed to descend into the generally longitudinally elongated annular cavity as the solid block of chemical is dissolved.

4. The dispenser of claim 3 further comprising:

(a) a water supply line connecting the spray means with a pressurized source of water; and (b) a spray control means cooperatively connected to the water supply line for selectively controlling the flow of water through the supply line and spray means, the spray control means being operative in response to receipt of a control signal to open the water supply line to water flow therethrough, causing the spray means to direct a spray of water against substantially the entire exposed surface of the solid block of chemical retainably supported immediately above the top portion of the support screen.

5. A dispenser for dispensing an aqueous chemical solution of substantially constant concentration from a solid block of chemical retained within a container, which comprises:

(a) a housing, having a central axis, for the solid block of chemical, comprising:

(i) an upper storage portion, the upper storage portion defining a storage cavity and having an upwardly disposed access port for allowing access to the storage cavity;

(ii) a door operatively engaged to the housing and positioned across the upwardly disposed access port, the door being movable with respect to the access port to open and close access to the storage cavity; and (iii) a funnel shaped collector portion integral with and extending continuously downward from the storage portion and terminating at a lower outlet port from the housing;

(b) mounting means for mounting the housing onto a vertical support;

(c) a three-dimensional screen comprising:

(i) a lower, substantially horizontal, circumferential support and extension portion in supportable contact with the housing and extending towards the central axis of the housing;

(ii) a substantially vertical circumferential wall integrally coupled with the lower support and extension portion; the wall extending into the storage portion of the housing and defining a generally longitudinally elongated annular cavity between the housing and the wall; and (iii) a substantially flat, horizontal top portion integrally coupled with the wall for supporting the block of chemical;

(d) spray means mounted in the collector portion of the housing and below the top portion of the support screen for directing a uniform spray at substantially the entire downwardly facing surface of the solid block of chemical retainably supported by the top portion of the support screen;

(e) a chemical solution conduit connecting the outlet port with a utilization point for directing the concentrated chemical solution from the collector portion of the housing to the utilization point;

(f) a water supply line connecting the spray means with a pressurized source of water; and (g) a spray control means cooperatively connected to the water supply line for selectively controlling the flow of water through the supply line and spray means, the spray control means being operative in response to receipt of a control signal to open the water supply line to water flow therethrough, causing the spray means to direct a spray of water against substantially the entire downwardly facing surface of the solid block of chemical retainably supported immediately above the top portion of the support screen, dissolving that chemical contacted with water which then passes in solution through the support screen to the underling collector portion of the housing, through the outlet port, through the conduit and to the utilization point; the container being allowed to descend into the generally longitudinally elongated annular cavity as the solid block of chemical is dissolved.

6. The dispenser of claim 5 further comprising a safety control switch responsive to movement of the door for blocking water spray from the spray means whenever the door is moved from a closed position overlying the access port of the housing, thereby preventing the creation of concentrated chemical solution when the access port is open.

7. The dispenser of claim 6, wherein the safety control switch comprises:

(a) an electrically actuated safety valve in the water supply line, normally operable in response to receipt of a first electrical signal to allow free flow of water through the supply line and responsive to receipt of a second electrical signal to block the flow of water through the water supply line; and (b) an electronic switching means operatively connected with the safety valve for sensing the operative position of the door and selectively producing in response thereto, the first and the second electrical signals, the electronic switching means being normally operative when the door is operatively disposed in a closed position over the access port of the housing, to produce the first electrical signal, and being operable in response to movement of the door away from the closed position to produce the second electrical signal, causing the safety valve to close.

8. The dispenser of claim 2 further comprising:

(a) a chemical solution conduit connecting the housing with a utilization point for directing the concentrated chemical solution from the housing to the utilization point;

(b) a pump cooperatively connected to the chemical solution conduit for selectively controlling the flow of chemical solution through the chemical solution conduit; the pump being operative in response to receipt of a control signal to pump chemical solution through the chemical solution conduit; and (c) a level indicator switch responsive to a level of chemical solution contained within the housing for blocking water spray from the spray means whenever the level of chemical solution retained within the housing is above a predetermined level, thereby preventing the creation of concentrated chemical solution when sufficient chemical solution is already present within the housing.

9. The dispenser of claim 5 further comprising:

(a) a pump cooperatively connected to the chemical solution conduit for selectively controlling the flow of chemical solution through the chemical solution conduit to the utilization point, the pump being operative in response to receipt of a control signal to pump chemical solution through the chemical solution conduit;

(b) an electrically actuated safety valve in the water supply line, normally operable in response to receipt of a first electrical signal to prevent the free flow of water through the supply line and responsive to receipt of a second electrical signal to open to the flow of water through the water supply line; and (c) a level indicator switch operatively connected with the safety valve for sensing a level of chemical solution within the collector portion of the housing and selectively producing in response thereto, first and second electrical signals, the level indicator switch being normally operative when the level of chemical solution within the collector portion of the housing is above a predetermined level, to produce the first electrical signal and prevent the free flow of water through the water supply line and being operable in response to movement of the level of chemical solution below the predetermined level to produce the second electrical signal, causing the safety valve to open to water flow therethrough.

10. The dispenser of claim 5 further comprising a lower screen in contact with the collector portion of the housing between the outlet port and the spray means for preventing the passage of undissolved solid block chemical into the chemical solution conduit.

11. The dispenser of claim 6 wherein the storage cavity and the support screen each comprise a right cylinder, a base area of the storage cavity larger than a base area of the support screen, the difference in base area creating the generally longitudinally elongated annular cavity.

12. The dispenser of claim 10 wherein the support screen has about 0.32 to 7.6 cm openings and the lower screen has about 0.63 to 0.13 cm openings.

13. The dispenser of claim 5 wherein the support screen wall is about 15 to 30 cm high.

14. The dispenser of claim 5 wherein the generally annular cavity is about 0.6 to 2.5 cm wide from housing to support screen wall.

15. A dispenser for dispensing an aqueous chemical solution of substantially constant concentration from a solid block of chemical retained within a container, the chemical retained within the container such that the chemical and container move as a single unit during dispensing, which comprises:

(a) a housing for the solid block of chemical, comprising:
  (i) a right circular cylinder upper storage portion, the upper storage portion defining a right circular cylinder storage cavity and having an upwardly disposed circular access port for allowing access to the storage cavity;
  (ii) a circular door operatively engaged to the housing and positioned across the upwardly disposed circular access port, the door being movable with respect to the access port to open and close access to the storage cavity; and
  (iii) a circular funnel-shaped collector portion integral with and extending continuously downward from the storage portion and terminating at a lower circular outlet port from the housing;
(b) means for mounting the housing onto a vertical support;
(c) a three-dimensional screen having approximately 2.5 cm openings comprising:
  (i) a lower, substantially horizontal, circumferential support and extension portion in supportable contact with the housing and extending toward the central axis of the housing;
  (ii) a substantially vertical circumferential wall about 15 to 30 cm high and integrally coupled with the lower support and extension portion; the wall extending into the storage portion of the housing and defining a generally longitudinal elongated annular cavity between the housing and the wall; the annular cavity being about 0.6 to 2.5 cm wide from housing to support screen wall and
  (iii) a substantially flat, horizontal top portion integrally coupled with the wall for supporting the block of chemical;
(d) a spray nozzle mounted in the collector portion of the housing and below the top portion of the screen for directing a uniform spray at substantially the entire downwardly facing surface of a solid block of chemical retainably supported by the top portion of the support screen;
(e) a chemical solution conduit connecting the outlet port with a utilization point for directing the concentrated chemical solution from the collector portion of the housing to the utilization point;
(f) a water supply line connecting the spray nozzle with a pressurized source of water;
(g) a spray control means cooperatively connected to the water supply line for selectively controlling the flow of water through the supply line and spray nozzle, the spray control means being operative in response to receipt of a control signal to open the water supply line to water flow therethrough, causing the spray nozzle to direct a spray of water against substantially the entire downwardly facing surface of the solid block of chemical retainably supported immediately above the top portion of the support screen;
(h) a safety control switch comprising:
  (i) an electrically actuated safety valve in the water supply line, normally operable in response to receipt of a first electrical signal to allow free flow of water through the supply line and responsive to receipt of a second electrical signal to block the flow of water through the water supply line and
  (ii) an electronic switching means operatively connected with the safety valve for sensing the operative position of the door and selectively producing in response thereto, the first and the second electrical signals, the electronic switching means being normally operative when the door is operatively disposed in a closed position over the access port of the housing, to produce the first electrical signal, and being operable in response to movement of the door away from the closed portion to produce the second electrical signal, causing the safety valve to close; and
(i) a lower screen in contact with the collector portion of the housing between the outlet port and the nozzle for preventing the passage of undissolved solid block chemical into the chemical solution conduit wherein the container is allowed to descend into the generally longitudinally elongated annular cavity as the solid block of chemical is dissolved.

16. The dispenser of claim 15 further comprising:
(a) a pump cooperatively connected to the chemical solution conduit for selectively controlling the flow of chemical solution through the chemical solution conduit to the utilization point, the pump being operative in response to receipt of a control signal to pump chemical solution through the chemical solution conduit; and
(b) a level indicator switch operatively connected to the safety control switch for sensing a level of chemical solution within the collector portion of the housing and selectively producing in response thereto, a third and a fourth electrical signal, the level indicator switch being normally operative when the level of chemical solution within the collector portion of the housing is above a predetermined level to produce the third electrical signal and prevent free flow of water through the water supply line and being operable in response to movement of the level of chemical solution below the predetermined level to produce the fourth electrical signal, causing the spray control means to open to water flow therethrough.

17. A method for dispensing an aqueous chemical solution of substantially constant concentration from a container surrounding a solid block of chemical, comprising the steps of:
(a) placing the chemical block into a dispenser comprising:
  (i) a fixed position spray means;
  (ii) a three-dimensional screen comprising:
    (A) a lower, substantially horizontal, circumferential support and extension portion in supportable contact with an outer housing, having a central axis, and extending towards the central axis of the housing;
    (B) a substantially vertical circumferential wall integrally coupled with the lower support and extension portion and extending upward; the wall and outer housing defining a generally longitudinally elongated annular cavity; and (C) a substantially flat, horizontal top portion integrally coupled with the wall for supporting the block of chemical; and (iii) a housing surrounding the container and spray means for containing, collecting and directing the chemical solution formed therein;

such that an exposed surface of the chemical supportably engages the top portion of the support screen and the container is aligned so that it may descend into the generally longitudinally elongated annular cavity as the solid block of chemical is dissolved; and (b) spraying water from the spray means onto the exposed surface of the solid block of chemical retainably supported immediately above the top portion of the support screen.

18. The method of claim 17 wherein the water spraying step is controlled by a spray control means for selectively controlling the spray of water onto the chemical solid block, the spray control means being operative in response to receipt of a control signal to begin spraying.

19. The method of claim 17 further comprising the steps of:

(a) opening a door which is operatively engaged to the housing and positioned across an upwardly disposed access port to allow access to the support screen; and (b) closing the door after placing the container onto the support screen to prevent the spray of concentrated chemical solution out of the dispenser through the access port.

20. The method of claim 19 wherein water spray from the spray means is prevented whenever the door is moved from a closed position overlying the access port of the housing, thereby preventing the creation of a concentrated chemical solution when the access port is open.

* * * * *

UNITED STATES PATENT AND TRADEMARK OFFICE

CERTIFICATE OF CORRECTION

PATENT NO. : 4,687,121 Page 1 of 2

DATED : Aug. 18, 1987

INVENTOR(S) : James L. Copeland

It is certified that error appears in the above-identified patent and that said Letters Patent is hereby corrected as shown below:

The Title Page should be deleted to appear as per attached Title Page.

Signed and Sealed this

Twenty-second Day of March, 1988

*Attest:*

DONALD J. QUIGG

*Attesting Officer*

*Commissioner of Patents and Trademarks*

United States Patent [19]

Copeland, James L.

[11] Patent Number: 4,687,121

[45] Date of Patent: Aug. 18, 1987

[54] SOLID BLOCK CHEMICAL DISPENSER FOR CLEANING SYSTEMS

[75] Inventor: Copeland, James L., Burnsville, Minn.

[73] Assignee: Ecolab Inc., St. Paul, Minn.

[21] Appl. No.: 817,399

[22] Filed: Jan. 9, 1986

[51] Int. Cl.[4] ..... B67D 5/08

[52] U.S. Cl. ..... 222/64; 222/67; 222/185; 222/189; 222/190; 222/325; 134/93; 68/17 R; 137/268; 422/263; 422/264; 422/266

[58] Field of Search ..... 222/52, 64, 67, 185, 222/189, 190, 251, 352, 462; 422/261, 263, 264, 266, 267, 268, 274, 277, 264 B; 134/57 DL, 58 DL, 93; 68/17 R; 252/93; 137/268

[56] References Cited

U.S. PATENT DOCUMENTS

| | | | |
|---|---|---|---|
| 404,354 | 5/1989 | Huber . | |
| 871,612 | 11/1907 | Nesfield . | |
| 1,325,361 | 1/1919 | Harshberger . | |
| 1,380,388 | 6/1921 | Kaufman . | |
| 1,740,879 | 12/1929 | Sonner | 137/268 |
| 1,798,428 | 3/1931 | Lindgren . | |
| 1,932,070 | 10/1933 | Grant et al. | 141/9 |
| 1,945,351 | 1/1934 | Grafton | 220/62 |
| 1,949,264 | 2/1934 | Bagley | 226/69 |
| 1,975,749 | 10/1934 | Lang | 141/9 |
| 1,988,000 | 1/1935 | Estler | 225/12 |
| 2,031,853 | 2/1936 | Potts | 226/93 |
| 2,083,076 | 6/1937 | Mau | 23/268 |
| 2,120,807 | 6/1938 | Kundel | 299/34 |
| 2,138,943 | 12/1938 | Sinkwich | 141/9 |
| 2,238,969 | 4/1941 | Butterfield | 299/34 |
| 2,288,791 | 7/1942 | Cullitoe | 299/83 |
| 2,308,612 | 1/1943 | Lehmkuhl | 23/272 |
| 2,333,443 | 11/1943 | Robinson | 252/135 |
| 2,370,609 | 2/1945 | Wilson et al. | 175/183 |
| 2,371,720 | 3/1945 | Stine | 299/83 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 2,387,945 | 10/1945 | McDow | 299/84 |
| 2,412,819 | 12/1946 | MacMahon | 252/138 |

(List continued on next page.)

FOREIGN PATENT DOCUMENTS

| | | | |
|---|---|---|---|
| 8912 | of 1916 | United Kingdom | 422/263 |

OTHER PUBLICATIONS

Economics Laboratory, Inc., Warhead Chlorinated Brick Detergent, p. 1.

Klenzade Products, Inc., Detergent Bricks, pp. 1-2.

Economics Laboratory, Inc., Model C-8, pp. 1-3.

Economics Laboratory, Inc., C-33 Hydraulic Reservoir, p. 1.

Economics Laboratory, Inc., Detergent Reservoirs, pp. 1-2.

Economics Laboratory, Inc., Model C-11, pp. 1-2.

Economics Laboratory, Inc., Model C-4, pp. 1-2.

*Primary Examiner*—Joseph J. Rolla

*Assistant Examiner*—Edward S. Ammeen

*Attorney, Agent, or Firm*—Merchant, Gould, Smith, Edell, Welter & Schmidt

[57] ABSTRACT

A spray-type dispenser for on-demand dispensing of a solid block of chemical retained within a container in the form of an aqueous chemical solution of substantially constant concentration, comprising: (i) an upwardly dispoded spray nozzle, (ii) a three-dimensional support screen for supporting the solid block of chemical above the spray nozzle, and (iii) a housing enclosing the spray nozzle and support screen; the housing and support screen defining an annular cavity. In operation, a container retaining a solid block of a water-soluble chemical is placed within the dispenser such that the support screen contacts the chemical but not the container; thereby allowing the container to descend, by force of gravity into the annula cavity as the chemical retained therein is dissolved. The ability of the container to move in relation to dissolution of the chemical retained therein allows the dispenser to maintain a substantially constant distance between the spray nozzle and the exposed dissolving surface of the chemical and thereby maintains a substantially constant concentration of the aqueous chemical solution dispensed.

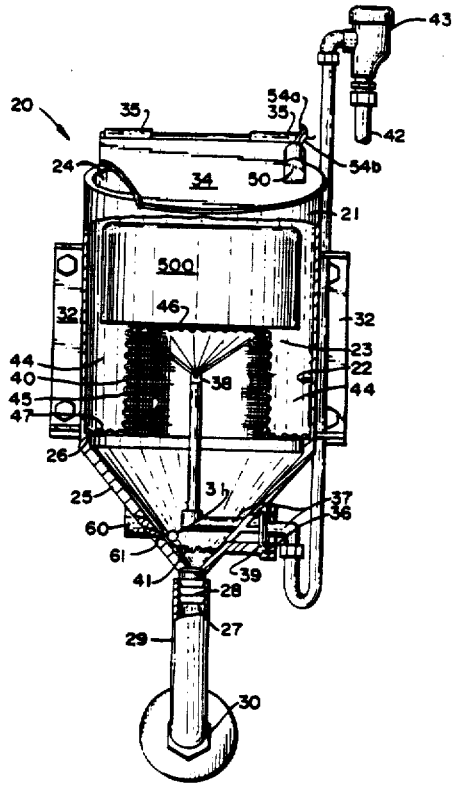

20 Claims, 13 Drawing Figures